US009105265B2

(12) United States Patent
Wu et al.

(10) Patent No.: US 9,105,265 B2
(45) Date of Patent: Aug. 11, 2015

(54) STEREO CODING METHOD AND APPARATUS

(75) Inventors: Wenhai Wu, Beijing (CN); Lei Miao, Beijing (CN); Yue Lang, Munich (DE); Qi Zhang, Beijing (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 484 days.

(21) Appl. No.: 13/567,982

(22) Filed: Aug. 6, 2012

(65) Prior Publication Data

US 2012/0300945 A1 Nov. 29, 2012

Related U.S. Application Data

(63) Continuation of application No. PCT/CN2010/079410, filed on Dec. 3, 2010.

(30) Foreign Application Priority Data

Feb. 12, 2010 (CN) ..... 2010 1 0113805

(51) Int. Cl.
*H04R 5/00* (2006.01)
*G10L 19/008* (2013.01)

(52) U.S. Cl.
CPC ..... *G10L 19/008* (2013.01)

(58) Field of Classification Search
CPC ..... H04R 3/005; H04R 1/083; H04R 1/1041; H04R 1/1083; H04R 2203/12; H04R 2227/007; H04R 2420/07; H04R 27/00; H04R 3/00; H04R 5/033; H04R 5/04; G10L 19/008; G10L 19/035; G10L 19/26; G10L 19/00; G10L 19/0017; G10L 19/0204; G10L 19/167
USPC ..... 381/1–4, 17–23; 704/500, 501–504, 704/200, 200.1, 201, 218, 216; 700/94
See application file for complete search history.

(56) References Cited

U.S. PATENT DOCUMENTS 7,542,896 B2 * 6/2009 Schuijers et al. ..... 704/201
7,720,231 B2 * 5/2010 Breebaart ..... 381/23

(Continued)

FOREIGN PATENT DOCUMENTS

CN 1647155 A 7/2005
CN 1748247 A 3/2006

(Continued)

OTHER PUBLICATIONS

International Search Report regarding International Patent Application No. PCT/CN2010/079410, dated Mar. 10, 2011, 9 pages.

(Continued)

*Primary Examiner* — Lun-See Lao
(74) *Attorney, Agent, or Firm* — Slater & Matsil, L.L.P.

(57) ABSTRACT

A stereo coding method includes transforming a stereo left channel signal and a stereo right channel signal in a time domain to a frequency domain to form a left channel signal and a right channel signal in the frequency domain; down-mixing the left channel signal and the right channel signal in the frequency domain to generate a monophonic down-mix signal, and transmitting bits obtained after quantization coding is performed on the down-mix signal; extracting spatial parameters of the left channel signal and the right channel signal in the frequency domain; estimating a group delay and a group phase between stereo left and right channels by using the left channel signal and the right channel signal in the frequency domain; and performing quantization coding on the group delay, the group phase and the spatial parameters, so as to obtain a high-quality stereo coding performance at a low bit rate.

13 Claims, 9 Drawing Sheets

(56) References Cited

U.S. PATENT DOCUMENTS

| | | | | |
|---|---|---|---|---|
| 7,916,873 | B2 * | 3/2011 | Villemoes et al. | 381/22 |
| 8,340,302 | B2 * | 12/2012 | Breebaart et al. | 381/17 |
| 2005/0177360 | A1 | 8/2005 | Schuijers et al. | |
| 2007/0036360 | A1 | 2/2007 | Breebaart | |
| 2007/0127729 | A1 | 6/2007 | Breebaart et al. | |
| 2008/0097766 | A1 | 4/2008 | Kim et al. | |
| 2008/0170711 | A1 | 7/2008 | Breebaart et al. | |
| 2009/0043591 | A1 * | 2/2009 | Breebaart et al. | 704/500 |
| 2010/0318353 | A1 * | 12/2010 | Bizjak | 704/231 |
| 2011/0211703 | A1 | 9/2011 | Villemoes et al. | |
| 2012/0189127 | A1 * | 7/2012 | Wu et al. | 381/22 |
| 2012/0300945 | A1 | 11/2012 | Wu et al. | |

FOREIGN PATENT DOCUMENTS

| | | | |
|---|---|---|---|
| CN | 1860526 | A | 11/2006 |
| CN | 101036183 | A | 9/2007 |
| CN | 101149925 | A | 3/2008 |
| CN | 101162904 | A | 4/2008 |
| CN | 101313355 | A | 11/2008 |
| CN | 102157152 | B | 4/2014 |
| EP | 2138999 | A1 | 12/2009 |
| EP | 2144229 | A1 | 1/2010 |
| WO | WO 2009/042386 | A1 | 4/2009 |

OTHER PUBLICATIONS

Written Opinion of the International Searching Authority regarding International Patent No. PCT/CN2010/079410, dated Mar. 10, 2011, 5 pages.

International Telecommunication Union, "Series G: Transmission Systems and Media, Digital Systems and Networks—Digital Terminal Equipments—Coding of Analogue Signals by Pulse Code Modulation—Wideband Embedded Extension for G.711 Pulse Code Modulation," ITU-T, G.711.1, dated Mar. 2008, 82 pages.

"Series G: Transmission Systems and Media, Digital Systems and Networks Digital terminal equipments—Coding of analogue signals by methods other than PCM," International Telecommunicaton Union, ITU-T, Telecommunicaton Standardization Sector of ITU, G.722 Appendix IV, Nov. 2006, 24 pages.

* cited by examiner

STEREO CODING METHOD AND APPARATUS

CROSS-REFERENCE TO RELATED APPLICATIONS

This application is a continuation of International Application No. PCT/CN2010/079410, filed Dec. 3, 2010, which claims priority to Chinese Patent Application No. 201010113805.9, filed Feb. 12, 2010, both of which applications are incorporated herein by reference.

TECHNICAL FIELD

The present invention relates to the field of multimedia, and in particular, to a stereo coding method and an apparatus.

BACKGROUND

Existing stereo coding methods include intensity stereo, BCC (Binaual Cure Coding), and a PS (Parametric-Stereo coding) coding method, and in a general case, when the intensity coding is used, it is needed to extract an ILD (Inter-Channel Level Difference) parameter, use the ILD parameter as side information to perform coding, and transmit it preferentially to a decoding end for helping to restore a stereo signal. An ILD is a ubiquitous signal characteristic parameter that reflects a sound field signal, and the ILD can well embody sound field energy; however, sound fields of background space and left and right directions often exist in stereo, and a manner of only transmitting the ILD to restore the stereo no longer meets the requirement of restoring an original stereo signal. Therefore, a solution of transmitting more parameters to better restore the stereo signal is proposed, in addition to extracting the most basic ILD parameter, transmitting an interchannel phase difference (IPD: InterChannel Phase Difference) of a left channel and a right channel, and an inter-channel cross correlation (ICC) parameter of the left channel and the right channel are also proposed, sometimes an overall phase difference (OPD) parameter of the left channel and a down-mix signal may also be included, and these parameters which reflect sound field information of the background space and left and right directions in the stereo signal and the ILD parameter are together used as the side information for coding and sent to the decoding end to restore the stereo signal.

The coding bit rate is an important factor for evaluating multimedia signal coding performance, and an adoption of a low bit rate is a goal that is pursued in common in the industry. An existing stereo coding technology definitely needs to improve the coding bit rate when transmitting the ILD as well as transmitting the IPD, ICC and OPD parameters at the same time, because the IPD, ICC and OPD parameters are local characteristic parameters of a signal that are used to reflect sub-band information of the stereo signal. Coding of the IPD, ICC and OPD parameters of the stereo signal needs to code the IPD, ICC and OPD parameters for each sub-band of the stereo signal, and for each sub-band of the stereo signal, IPD coding for each sub-band needs multiple bits, ICC coding for each sub-band needs multiple bits, and the rest may be deduced by analogy. Therefore, the stereo coding parameters need a large number of bits to enhance sound field information, but only part of the sub-bands can be enhanced at a lower bit rate, which cannot achieve a living restore effect. As a result, stereo information restored at the low bit rate and an original input signal have a great difference, which may bring extremely uncomfortable listening experience to a listener in term of a sound effect.

SUMMARY OF THE INVENTION

Embodiments of the present invention provide a stereo coding method, an apparatus and a system.

An embodiment of the present invention provides a stereo coding method. A stereo left channel signal and a stereo right channel signal in a time domain are transformed to a frequency domain to form a left channel signal and a right channel signal in the frequency domain. The left channel signal and the right channel signal in the frequency domain are down-mixed to generate a monophonic down-mix signal. Bits obtained after quantization coding is performed on the down-mix signal are transmitted. Spatial parameters of the left channel signal and the right channel signal in the frequency domain are extracted. A group delay and a group phase between stereo left and right channels are estimated using the left channel signal and the right channel signal in the frequency domain. Quantization coding on the group delay, the group phase and the spatial parameters is performed.

An embodiment of the present invention provides a stereo signal estimating method. A weighted cross correlation function between stereo left and right channel signals in a frequency domain is determined. The weighted cross correlation function is pre-processed to obtain a pre-processing result. A group delay and a group phase between the stereo left and right channel signals are estimated according to the pre-processing result.

An embodiment of the present invention provides a stereo signal estimating apparatus. A weighted cross correlation unit is configured to determine a weighted cross correlation function between stereo left and right channel signals in a frequency domain. A pre-processing unit is configured to pre-process the weighted cross correlation function to obtain a pre-processing result. An estimating unit is configured to estimate a group delay and a group phase between the stereo left and right channel signals according to the pre-processing result.

An embodiment of the present invention provides a stereo signal coding device. A transforming apparatus is configured to transform a stereo left channel signal and a stereo right channel signal in a time domain to a frequency domain to form a left channel signal and a right channel signal in the frequency domain. A down-mixing apparatus is configured to down-mix the left channel signal and the right channel signal in the frequency domain to generate a monophonic down-mix signal. A parameter extracting apparatus is configured to extract spatial parameters of the left channel signal and the right channel signal in the frequency domain. A stereo signal estimating apparatus is configured to estimate a group delay and a group phase between stereo left and right channels by using the left channel signal and the right channel signal in the frequency domain. A coding apparatus is configured to perform quantization coding on the group delay, the group phase, the spatial parameters and the monophonic down-mix signal.

An embodiment of the present invention provides a stereo signal coding system. A stereo signal coding device as described above can be combined with a receiving device and a transmitting device. The receiving device is configured to receive a stereo input signal and provide the stereo input signal for the stereo signal coding device. The transmitting device is configured to transmit a result of the stereo signal coding device.

BRIEF DESCRIPTION OF THE DRAWINGS

To more clearly illustrate the technical solutions according to the embodiments of the present invention or in the prior art, accompanying drawings for describing the embodiments or the prior art are introduced briefly below. Apparently, the accompanying drawings in the following description are only some embodiments of the present invention, and persons of ordinary skill in the art may obtain other drawings from the accompanying drawings without making creative efforts.

DETAILED DESCRIPTION OF ILLUSTRATIVE EMBODIMENTS

The technical solutions of the present invention are clearly and completely described below with reference to the accompanying drawings of the present invention. Obviously, the embodiments described are only part of rather than all of the embodiments of the present invention. All other embodiments obtained by persons of ordinary skill in the art based on the embodiments of the present invention without making creative efforts shall fall within the protection scope of the present invention.

Figure 1:
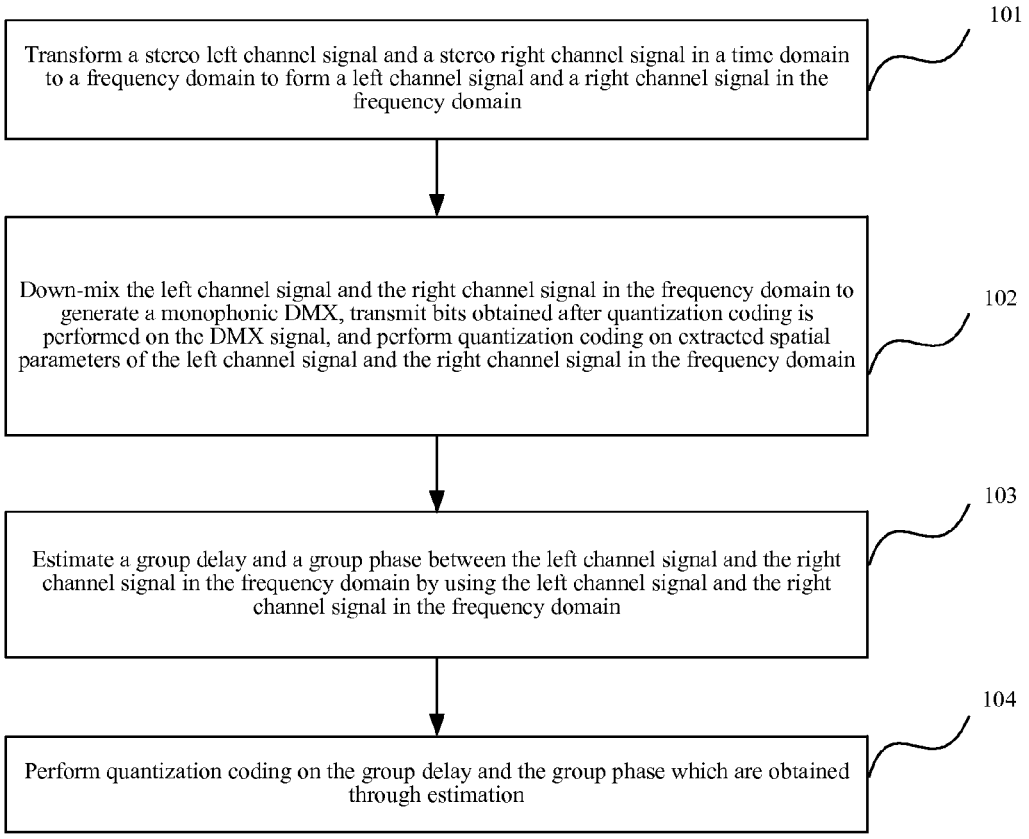
FIG. 1 is a schematic diagram of an embodiment of a stereo coding method.

FIG. 1 is a schematic diagram of a first embodiment of a stereo coding method. The method includes the following steps.

Step 101: Transform a stereo left channel signal and a stereo right channel signal in a time domain to a frequency domain to form a left channel signal and a right channel signal in the frequency domain.

Step 102: Down-mix the left channel signal and the right channel signal in the frequency domain to generate a monophonic down-mix (DMX) signal, transmit bits after quantization coding of the DMX signal, and perform quantization coding on extracted spatial parameters of the left channel signal and the right channel signal in the frequency domain.

A spatial parameter is a parameter denoting a stereo signal spatial characteristic, for example, an ILD parameter.

Step 103: Estimate a group delay (Group Delay) and a group phase (Group Phase) between the left channel signal and the right channel signal in the frequency domain by using the left channel signal and the right channel signal in the frequency domain.

The group delay reflects global orientation information of a time delay of an envelope between the stereo left and right channels, and the group phase reflects global information of waveform similarity of the stereo left and right channels after time alignment.

Step 104: Perform quantization coding on the group delay and the group phase which are obtained through estimation.

The group delay and the group phase form, through quantization coding, contents of side information code stream that are to be transmitted.

In the stereo coding method according to the embodiments of the present invention, the group delay and group phase are estimated while spatial characteristic parameters of the stereo signal are extracted, and the estimated group delay and group phase are applied to stereo coding, so that the spatial parameters and the global orientation information are combined efficiently, more accurate sound field information can be obtained at a low bit rate by using a global orientation information estimating method, a sound field effect is enhanced, and coding efficiency is improved greatly.

Figure 2:
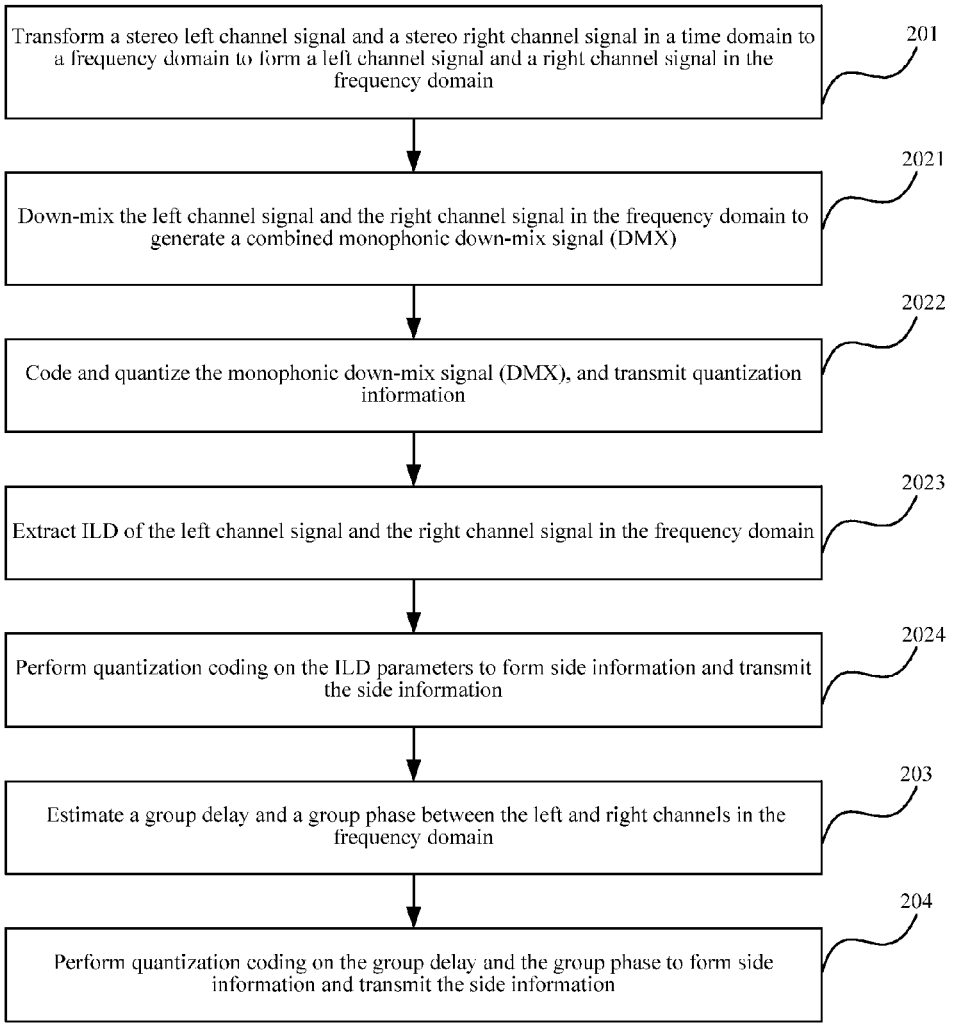
FIG. 2 is a schematic diagram of another embodiment of a stereo coding method.

FIG. 2 is a schematic diagram of a second embodiment of a stereo coding method. The method includes the following steps.

Step 201: Transform a stereo left channel signal and a stereo right channel signal in a time domain to a frequency domain to form a stereo left channel signal $X_1(k)$ and a right channel signal $X_2(k)$ in the frequency domain, where k is an index value of a frequency point of a frequency signal.

Step 202: Down-mix the left channel signal and the right channel signal in the frequency domain, code and quantize a down-mix signal and transmit the down-mix signal, code stereo spatial parameters, form side information by quantization and transmit the side information, which may include the following steps.

Step 2021: Down-mix the left channel signal and the right channel signal in the frequency domain to generate a combined monophonic down-mix signal (DMX).

Step 2022: Code and quantize the monophonic down-mix signal (DMX), and transmit quantization information.

Step 2023: Extract ILD parameters of the left channel signal and the right channel signal in the frequency domain.

Step 2024: Perform quantization coding on the ILD parameters to form side information and transmit the side information.

Steps 2021 and 2022 are independent of steps 2023 and 2024, the steps may be executed independently, and side information formed by the former may be multiplexed with side information formed by the latter for transmission.

In another embodiment, frequency-time transform may be performed on the monophonic down-mix signal obtained through the down-mixing, so as to obtain a time domain signal of the monophonic down-mix signal (DMX), and bits after quantization coding of the time domain signal of the monophonic (DMX) are transmitted.

Step 203: Estimate a group delay and a group phase between the stereo left and right channel signals in the frequency domain.

Figure 3:
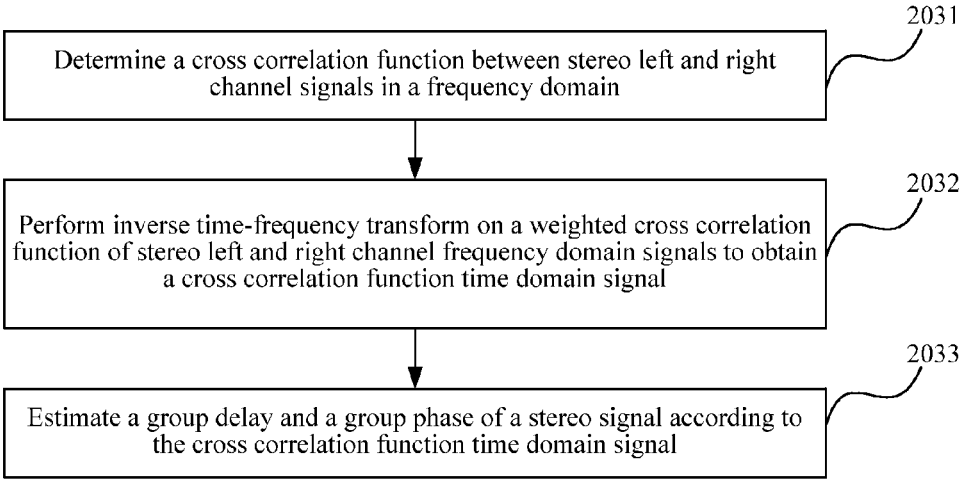
FIG. 3 is a schematic diagram of another embodiment of a stereo coding method.

The estimating a group delay and a group phase between the left and right channel signals by using the left and right channel signals in the frequency domain includes determining a cross correlation function relating to stereo left and right channel frequency domain signals, estimating the group delay and the group phase of a stereo signal according to a signal of the cross correlation function. As shown in FIG. 3, the following specific steps may be included:

Step 2031: Determine a cross correlation function between the stereo left and right channel signals in the frequency domain.

The cross correlation function of the stereo left and right channel frequency domain signals may be a weighted cross correlation function, weighting operation is performed on the cross correlation function which is for estimating the group delay and the group phase in a procedure of determining the cross correlation function, where the weighting operation makes a stereo signal coding result more likely to be stable as compared with other operations, the weighted cross correlation function is weighting of a conjugate product of the left channel frequency domain signal and the right channel frequency domain signal, and a value of the weighted cross correlation function in frequency points which are half of the points having stereo signal time-frequency transform length N is 0. A form of the cross correlation function of the stereo left and right channel frequency domain signals may be denoted as follows:

$$C_r(k) = \begin{matrix} W(k)X_1(k)X_2^*(k) & 0 \le k \le N/2 \\ 0 & k > N/2, \end{matrix}$$

where w(k) denotes a weighted function, $X^*_2(k)$ denotes a conjugate function of $X_2(k)$, or may be denoted as $C_r(k)=X_1(k)X^*_2(k)$ $0 \le k \le N/2+1$. In a form of another cross correlation function, in combination with different weighting forms, the cross correlation function of the stereo left and right channel frequency domain signals may be denoted as follows:

$$C_r(k) = \begin{matrix} X_1(k)X_2^*(k)/|X_1(k)||X_2(k)| & k = 0 \\ 2*X_1(k)X_2^*(k)/|X_1(k)||X_2(k)| & 1 \le k \le N/2-1 \\ X_1(k)X_2^*(k)/|X_1(k)||X_2(k)| & k = N/2 \\ 0 & k > N/2, \end{matrix}$$

where N denotes stereo signal time-frequency transform length, and $|X_1(k)|$ and $|X_2(k)|$ denotes amplitudes corresponding to $X_1(k)$ and $X_2(k)$, respectively. The weighted cross correlation function in a frequency point 0 and a frequency point N/2 is a reciprocal of a product of amplitudes of the left and right channel signals in corresponding frequency points, and the weighted cross correlation function in other frequency points is twice the reciprocal of the product of amplitudes of the left and right channel signals. In other embodiments, the weighted cross correlation function of the stereo left and right channel frequency domain signals may also be denoted in other forms, for example:

$$C_r(k) = \begin{matrix} X_1(k)X_2^*(k)\Big/\sqrt{X_1(k)^2 + X_2(k)^2} & k = 0 \\ 2*X_1(k)X_2^*(k)\Big/\sqrt{X_1(k)^2 + X_2(k)^2} & 1 \le k \le N/2-1 \\ X_1(k)X_2^*(k)\Big/\sqrt{X_1(k)^2 + X_2(k)^2} & k = N/2 \\ 0 & k > N/2, \end{matrix}$$

Here, this embodiment does not make any limitation, and any transformation of the foregoing formulas falls within the protection scope.

Step 2032: Perform inverse time-frequency transform on the weighted cross correlation function of the stereo left and right channel frequency domain signals to obtain a cross correlation function time domain signal $C_r$ (n), and here the cross correlation function time domain signal is a complex signal.

Step 2033: Estimate the group delay and the group phase of the stereo signal according to the cross correlation function time domain signal.

In another embodiment, the group delay and the group phase of the stereo signal may be estimated directly according to the cross correlation function between the stereo left and right channel signals in the frequency domain which is determined in step 2031.

In step 2033, the group delay and the group phase of the stereo signal may be estimated directly according to the cross correlation function time domain signal; or some signal pre-processing may be performed on the cross correlation function time domain signal, and the group delay and the group phase of the stereo signal are estimated based on the pre-processed signal.

If some signal pre-processing is performed on the cross correlation function time domain signal, estimating the group delay and the group phase of the stereo signal based on the pre-processed signal may include:

Normalizing or smoothing the cross correlation function time domain signal;

where the smoothing the cross correlation function time domain signal may be performed as follows:

$$C_{ravg}(n)=\alpha*C_{ravg}(n-1)+\beta*C_r(n)$$

where $C_{ravg}(n)$ is a smoothing result, $\alpha$ and $\beta$ are weighted constants, $0 \le \alpha \le 1$, $\beta=1-\alpha$, n is a frame number, and $C_r(n)$ is a cross correlation function of the nth frame. In this embodiment, pre-processing such as smoothing is performed on the obtained cross correlation function time domain signal between the left and right channels before estimating the group delay and the group phase, so that the group delay estimated is more stable.

Further smoothing the cross correlation function time domain signal after the normalizing;

Normalizing or smoothing an absolute value of the cross correlation function time domain signal;

where the smoothing the absolute value of the cross correlation function time domain signal may be performed as follows:

$$C_{ravg_abs}(n)=\alpha*C_{ravg}(n-1)+\beta*|C_r(c)|,$$

Further smoothing an absolute value signal of the cross correlation function time domain signal after the normalizing.

It may be understood that, before estimating the group delay and the group phase of the stereo signal, the pre-processing of the cross correlation function time domain signal may also include other processing, such as self-correlation processing, and at this time, the pre-processing of the cross correlation function time domain signal may also include self-correlation processing and/or smoothing.

In combination with the foregoing pre-processing of the cross correlation function time domain signal, in step 2033, the group delay and the group phase may be estimated in the same manner, or be estimated separately, and specifically, the following implementation manners of estimating the group delay and the group phase can be adopted.

Figure 4A:
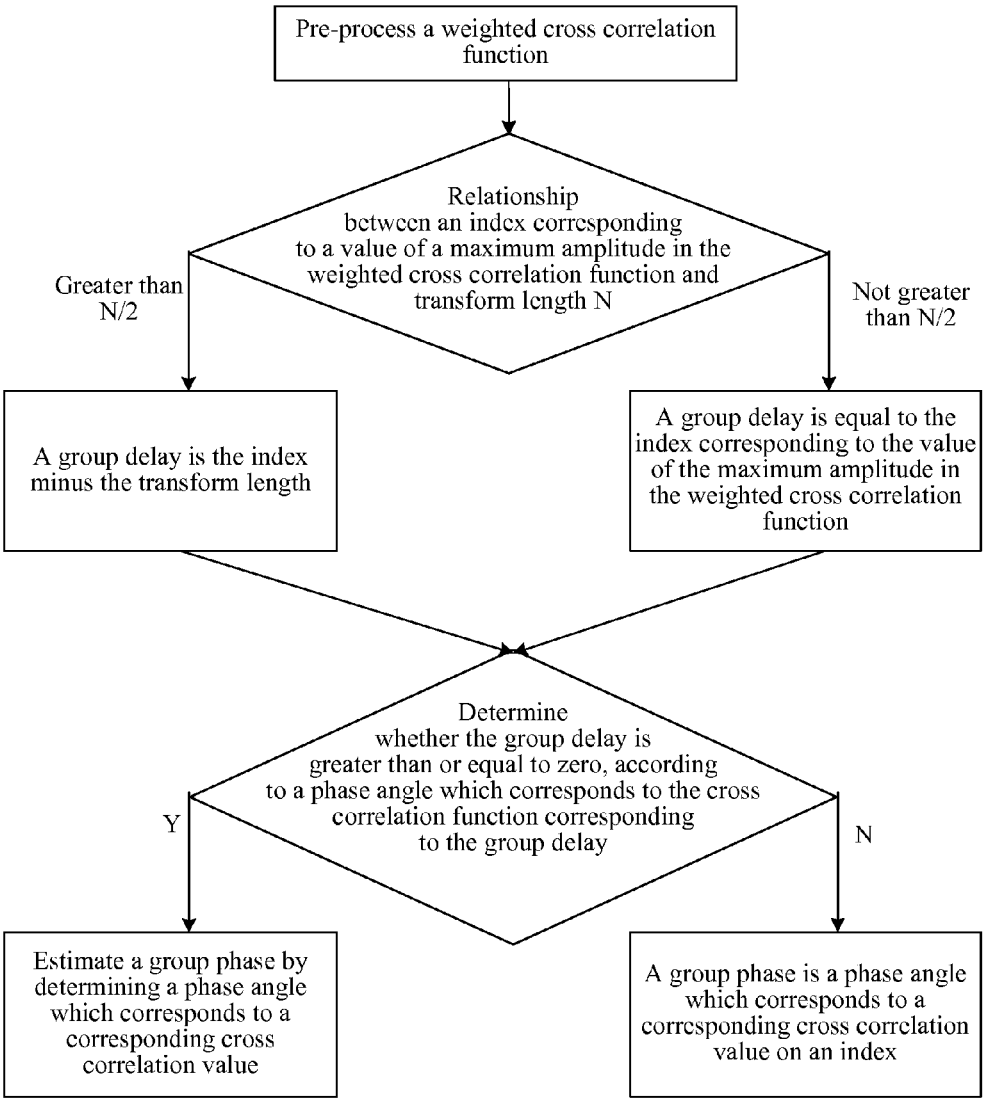
FIG. 4*a* is a schematic diagram of another embodiment of a stereo coding method.

Step 2033 A first implementation manner is as shown in FIG. 4*a*.

Estimate the group delay according to the cross correlation function time domain signal or based on an index corresponding to a value of a maximum amplitude in the processed cross correlation function time domain signal, obtain a phase angle which corresponds to a cross correlation function corresponding to the group delay, and estimate the group phase according to the phase angle, where the manner includes the following steps.

Judge a relationship between an index corresponding to a value of a maximum amplitude in the time domain signal cross correlation function and a symmetric interval related to the transform length N. In one embodiment, if the index corresponding to the value of the maximum amplitude in the time domain signal cross correlation function is smaller than or equal to N/2, the group delay is equal to the index corresponding to the value of the maximum amplitude in the time domain signal cross correlation function, and if the index corresponding to the value of the maximum amplitude in the time domain signal cross correlation function is greater than N/2, the group delay is the index minus the transform length N. [0, N/2] and (N/2, N] can be regarded as a first symmetric interval and a second symmetric interval which are related to the stereo signal time-frequency transform length N.

In another embodiment, the judgment range may be a first symmetric interval and a second symmetric interval of [0, m] and (N−m, N], where m is smaller than N/2. The index corresponding to the value of the maximum amplitude in the time domain signal cross correlation function is compared with related information about m, if the index corresponding to the value of the maximum amplitude in the time domain signal cross correlation function is in the interval [0, m], the group delay is equal to the index corresponding to the value of the maximum amplitude in the time domain signal cross correlation function, and if the index corresponding to the value of the maximum amplitude in the time domain signal cross correlation function is in the interval (N−m, N], the group delay is the index minus the transform length N.

However, in a practical application, the judgment may be made on a critical value of the index corresponding to the value of the maximum amplitude in the time domain signal cross correlation function, and an index corresponding to a value slightly smaller than that of the maximum amplitude may be appropriately selected as a judgment condition without affecting a subjective effect or according to limitation of requirements, for example, an index corresponding to a value of the second greatest amplitude and an index corresponding to a value with a difference from that of the maximum amplitude in a fixed or preset range are both applicable.

By taking the index corresponding to the value of the maximum amplitude in the time domain signal cross correlation function as an example, a specific form is embodied as follows:

$$d_g = \begin{cases} \operatorname{argmax}|C_{ravg}(n)| & \operatorname{argmax}|C_{ravg}(n)| \le N/2 \\ \operatorname{argmax}|C_{ravg}(n)| - N & \operatorname{argmax}|C_{ravg}(n)| > N/2, \end{cases}$$

where arg max $|C_{ravg}(n)|$ denotes an index corresponding to a value of a maximum amplitude in $C_{ravg}(n)$, and various transformations of the foregoing form are also under the protection of this embodiment.

According to a phase angle which corresponds to the time domain signal cross correlation function corresponding to the group delay, when the group delay $d_g$ is greater than or equal to zero, estimate the group phase by determining a phase angle which corresponds to a cross correlation value corresponding to $d_g$; and when $d_g$ is less than zero, the group delay is a phase angle which corresponds to a cross correlation value corresponding to a $d_g$+N index, where one specific form below or any transformation of the form may be used:

$$\theta_g = \begin{cases} \angle C_{ravg}(d_g) & d_g \ge 0 \\ \angle C_{ravg}(d_g + N) & d_g < 0, \end{cases}$$

where $\angle C_{ravg}(d_g))$ denotes a phase angle of a time domain signal cross correlation function value $C_{ravg}(d_g)$, and $ZC_{ravg}(d_g+N)$ is a phase angle of a time domain signal cross correlation function value $C_{ravg}(d_g+N)$.

Figure 4B:
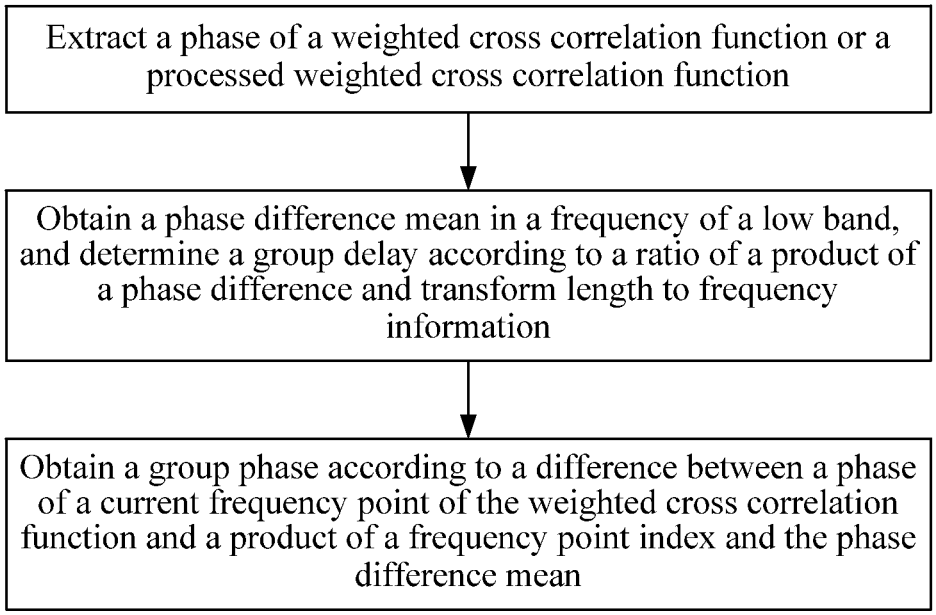
FIG. 4*b* is a schematic diagram of another embodiment of a stereo coding method.

Step 2033 A second implementation is as shown in FIG. 4*b*.

Extract a phase $\hat{\Phi}(k)=\angle C_r(k)$ of the cross correlation function or the processed cross correlation function, where a function $\angle C_r(k)$ is used to extract a phase angle of a complex number $C_r(k)$, obtain a phase difference mean $\alpha_1$ in a frequency of a low band, determine the group delay according to a ratio of a product of a phase difference and transform length to frequency information, and similarly, obtain information about the group phase according to a difference between a phase of a current frequency point of the cross correlation function and a product of a frequency point index and the phase difference mean, where the following manner may be specifically adopted:

$$\alpha_1 = E\{\hat{\Phi}(k+1) - \hat{\Phi}(k)\} \quad k < \text{Max};$$

$$d_g = -\frac{a_1 N}{2 * \pi * Fs};$$

$$\theta_g = E\{\hat{\Phi}(k) - a_1 * k\} \quad k < \text{Max},$$

where $E\{\hat{\Phi}(k+1)-\hat{\Phi}(k)\}$ denotes the phase difference mean, Fs denotes a frequency adopted, and Max denotes an cut-off upper limit for calculating the group delay and the group phase, so as to prevent phase rotation.

Step 204: Perform quantization coding on the group delay and the group phase to form side information and transmit the side information.

Scalar quantization is performed on the group delay in a preset or random range, the range includes symmetrical positive and negative values [−Max, Max] or available values in random conditions, the group delay after the scalar quantization is transmitted in a longer time or processed by differential coding to obtain the side information. A value of the group phase is usually in a range of [0, 2*π], specifically in a range of [0, 2*π), and the scalar quantization and coding may be also performed on the group phase in a range of (−π, π], the side information formed by the group delay and the group phase after the quantization coding is multiplexed to form a code stream, and the code stream is transmitted to a stereo signal restoring apparatus.

In the stereo coding method according to this embodiment of the present invention, the group delay and the group phase which are between the stereo left and right channels and can embody the signal global orientation information are estimated by using the left and right channel signals in the frequency domain, so that orientation information about sound field is efficiently enhanced, and stereo signal spatial characteristic parameters and the estimation of the group delay and the group phase are combined and applied to the stereo coding with a low demand of a bit rate, so that space information and the global orientation information are combined efficiently, more accurate sound field information is obtained, a sound field effect is enhanced, and coding efficiency is improved greatly.

Figure 5:
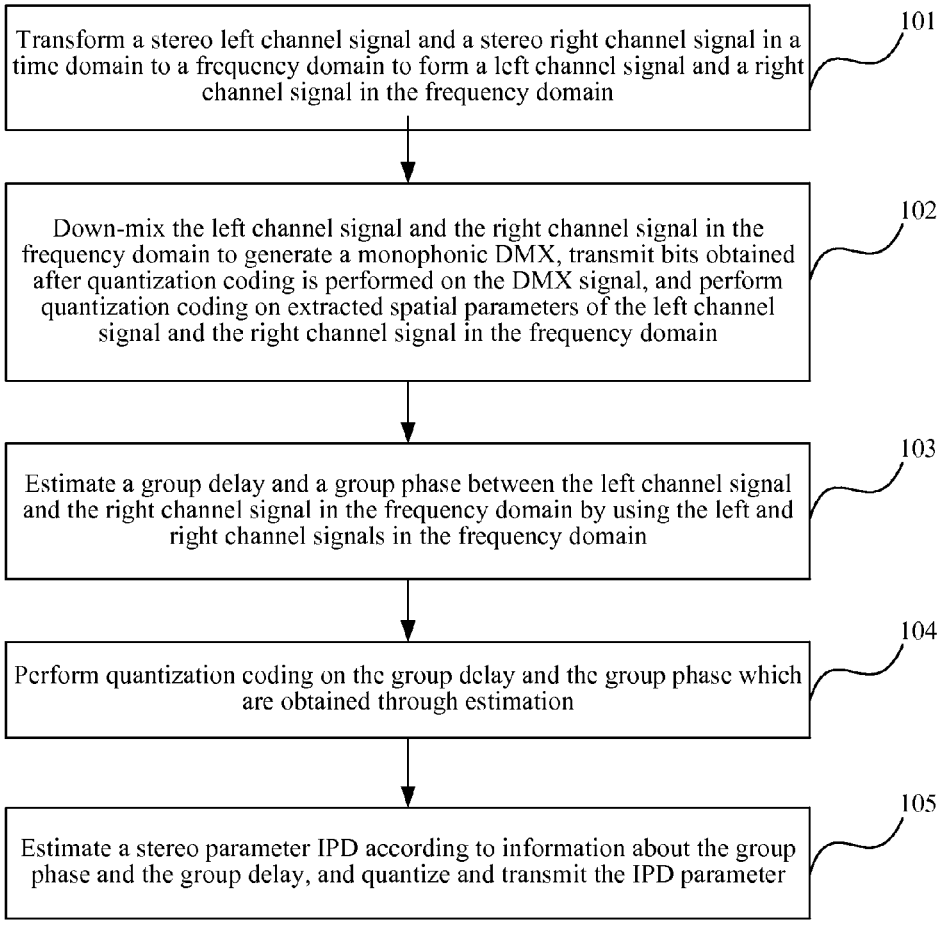
FIG. 5 is a schematic diagram of another embodiment of a stereo coding method.

FIG. 5 is a schematic diagram of a third embodiment of a stereo coding method, where the method includes steps as follows.

On the basis of the first and second embodiments, respectively, the stereo coding further includes the following steps.

Step 105/205: Estimate a stereo parameter IPD according to information about the group phase and the group delay, and quantize and transmit the IPD parameter.

When the IPD is quantized, the group delay (Group Delay) and group phase (Group Phase) are used to estimate $\overline{IPD(k)}$, differential processing is performed on $\overline{IPD(k)}$ and original IPD(k), and a differential IPD is quantization coded, which can be denoted as follows:

$$\overline{IPD(k)} = \frac{-2\pi d_g * k}{N} + \theta_g,\ 1 \le k \le N/2 - 1$$

$IPD_{diff}(k)=IPD(k)-\overline{IPD(k)}$, $IPD_{diff}(k)$ is quantized, and the quantized bits are sent to a decoding end. In another embodiment, the IPD may be directly quantized, where a bit stream is slightly higher, and quantization is more precise.

In this embodiment, the stereo parameter IPD is estimated, coded and quantized, which, in a case that a higher bit rate is available, may improve coding efficiency and enhance a sound field effect.

Figure 6:
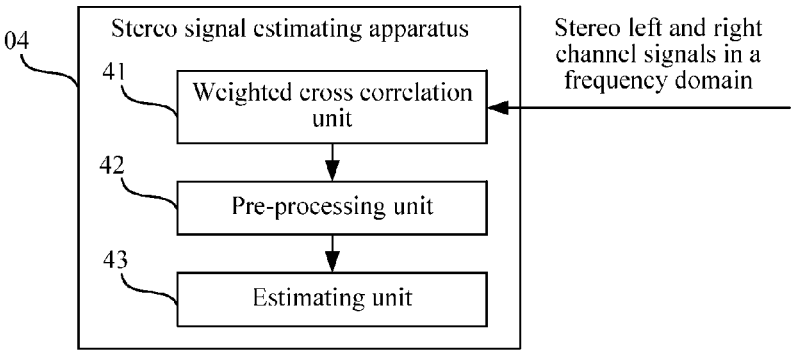
FIG. 6 is a schematic diagram of an embodiment of a stereo signal estimating apparatus.

FIG. 6 is a schematic diagram of a fourth embodiment of a stereo signal estimating apparatus 04. The apparatus includes a weighted cross correlation unit 41 that is configured to determine a weighted cross correlation function between stereo left and right channel signals in a frequency domain.

The weighted cross correlation unit 41 receives the stereo left and right channel signals in the frequency domain, processes the stereo left and right channel signals in the frequency domain to obtain the weighted cross correlation function between the stereo left and right channel signals in the frequency domain.

A pre-processing unit 42 is configured to pre-process the weighted cross correlation function. The pre-processing unit 42 receives the weighted cross correlation function obtained according to the weighted cross correlation unit 41, and pre-processes the weighted cross correlation function to obtain a pre-processing result, that is, a pre-processed cross correlation function time domain signal.

An estimating unit 43 is configured to estimate a group delay and a group phase between the stereo left and right channel signals according to the pre-processing result.

The estimating unit 43 receives the pre-processing result of the pre-processing unit 42, obtains the pre-processed cross correlation function time domain signal, extract information about the cross correlation function time domain signal and perform an operation of judging or comparing or calculating to estimate and obtain the group delay and the group phase between the stereo left and right channel signals.

In this another embodiment, the stereo signal estimating apparatus 04 may further include a frequency-time transforming unit 44, which is configured to receive output of the weighted cross correlation unit 41, perform inverse time-frequency transform on the weighted cross correlation function between the stereo left and right channel signals in the frequency domain and obtain the cross correlation function time domain signal, and transmit the cross correlation function time domain signal to the pre-processing unit 42.

With introduction of this embodiment of the present invention, the group delay and the group phase are estimated and applied to the stereo coding, so that more accurate sound field information can be obtained at a low bit rate by using a global orientation information estimating method, a sound field effect is enhanced, and coding efficiency is improved greatly.

Figure 7:
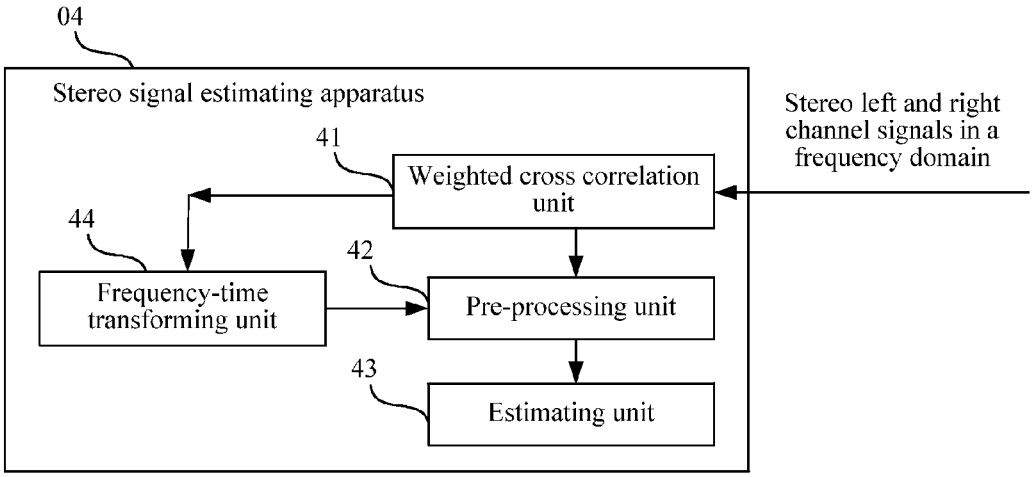
FIG. 7 is a schematic diagram of another embodiment of a stereo signal estimating apparatus.

FIG. 7 is a schematic diagram of a fifth embodiment of a stereo signal estimating apparatus 04. The apparatus includes the following units.

A weighted cross correlation unit 41 receives stereo left and right channel signals in a frequency domain, processes the stereo left and right channel signals in the frequency domain to obtain a weighted cross correlation function between the stereo left and right channel signals in the frequency domain. A cross correlation function of stereo left and right channel frequency domain signals may be a weighted cross correlation function, so that a coding effect is more stable, the weighted cross correlation function is weighting of a conjugate product of a left channel frequency domain signal and a right channel frequency domain signal, and a value of the weighted cross correlation function in frequency points which are half of the points having stereo signal time-frequency transform length N is 0. A form of the cross correlation function of the stereo left and right channel frequency domain signals may be denoted as follows:

$$C_r(k) = \begin{matrix} W(k)X_1(k)X_2^*(k) & 0 \le k \le N/2 \\ 0 & k > N/2, \end{matrix}$$

where w(k) denotes a weighted function, $X^*_2(k)$ denotes a conjugate function of $X_2(k)$, or may be denoted as $C_r(k)=X_1(k)X^*_2(k)$ $0 \le k \le N/2+1$. In a form of another weighted cross correlation function, in combination with different weighting forms, the weighted cross correlation function of the stereo left and right channel frequency domain signals may be denoted as follows:

$$C_r(k) = \begin{matrix} X_1(k)X_2^*(k)/|X_1(k)||X_2(k)| & k = 0 \\ 2 * X_1(k)X_2^*(k)/|X_1(k)||X_2(k)| & 1 \le k \le N/2 - 1 \\ X_1(k)X_2^*(k)/|X_1(k)||X_2(k)| & k = N/2 \\ 0 & k > N/2, \end{matrix}$$

where N denotes stereo signal time-frequency transform length, and $|X_1(k)|$ and $|X_2(k)|$ denote amplitudes corresponding to $X_1(k)$ and $X_2$ (k), respectively. The weighted cross correlation function in a frequency point 0 and a frequency point N/2 is a reciprocal of a product of amplitudes of the left and right channel signals in corresponding frequency points, and the weighted cross correlation function in other frequency points is twice the reciprocal of the product of amplitudes of the left and right channel signals.

Alternatively, the following form or its transformation may be adopted:

$$C_r(k) = \begin{matrix} X_1(k)X_2^*(k) \Big/ \sqrt{X_1(k)^2 + X_2(k)^2} & k = 0 \\ 2 * X_1(k)X_2^*(k) \Big/ \sqrt{X_1(k)^2 + X_2(k)^2} & 1 \le k \le N/2 - 1 \\ X_1(k)X_2^*(k) \Big/ \sqrt{X_1(k)^2 + X_2(k)^2} & k = N/2 \\ 0 & k > N/2. \end{matrix}$$

A frequency-time transforming unit 44 receives the weighted cross correlation function which is between the stereo left and right channel signals in the frequency domain and is determined by the weighted cross correlation unit 41, and performs inverse time-frequency transform on the weighted cross correlation function of the stereo left and right channel frequency domain signals and obtain a cross correlation function time domain signal $C_r(n)$, and here the cross correlation function time domain signal is a complex signal.

A pre-processing unit 42 receives the cross correlation function time domain signal obtained through frequency-time transform according to the cross correlation function, pre-processes the cross correlation function to obtain a pre-processing result, that is, the pre-processed cross correlation function time domain signal.

The pre-processing unit 42, according to different needs, may include one or more of the following units: a normalizing unit, a pre-processing unit, and an absolute value unit.

The normalizing unit normalizes the cross correlation function time domain signal or the pre-processing unit pre-processes the cross correlation function time domain signal.

The pre-processing the cross correlation function time domain signal may be performed as follows:

$$C_{ravg}(n)=\alpha*C_{ravg}(n-1)+\beta*C_r(n)$$

where $\alpha$ and $\beta$ are weighted constants, $0\leq\alpha\leq1$, $\beta=1-\alpha$. In this embodiment, processing such as pre-processing is performed on the obtained weighted cross correlation function between the left and right channels before estimating a group delay and a group phase, so that the estimated group delay is more stable.

After the normalizing unit normalizes the cross correlation function time domain signal, the pre-processing unit further pre-processes a result of the normalizing unit.

The absolute value unit obtains absolute value information of the cross correlation function time domain signal, the normalizing unit normalizes the absolute value information or the pre-processing unit pre-processes the absolute value information, or the absolute value information is first normalized and then pre-processed.

The pre-processing the absolute value of the cross correlation function time domain signal may be performed as follows:

$$C_{ravg_abs}(n)=\alpha*C_{ravg}(n-1)+\beta*|C_r(n)|.$$

An absolute value signal of the cross correlation function time domain signal after normalization is further pre-processed.

Before estimating the group delay and the group phase of a stereo signal, the pre-processing unit 42 may also include another processing unit for the pre-processing of the cross correlation function time domain signal, such as a self-correlation unit configured to perform a self-correlation operation, and at this time, the pre-processing by the pre-processing unit 42 on the cross correlation function time domain signal may further include processing such as self-correlation and/or pre-processing.

In another embodiment, the stereo signal estimating apparatus 04 may not include the pre-processing unit, the result of the frequency-time transforming unit 44 is directly sent to an estimating unit 43 of the stereo signal estimating apparatus 4 as follows, the estimating unit 43 is configured to estimate the group delay according to the weighted cross correlation function time domain signal or based on an index corresponding to a value of a maximum amplitude in the processed weighted cross correlation function time domain signal, obtain a phase angle which corresponds to the time domain signal cross correlation function corresponding to the group delay, and estimate the group phase.

Figure 8:
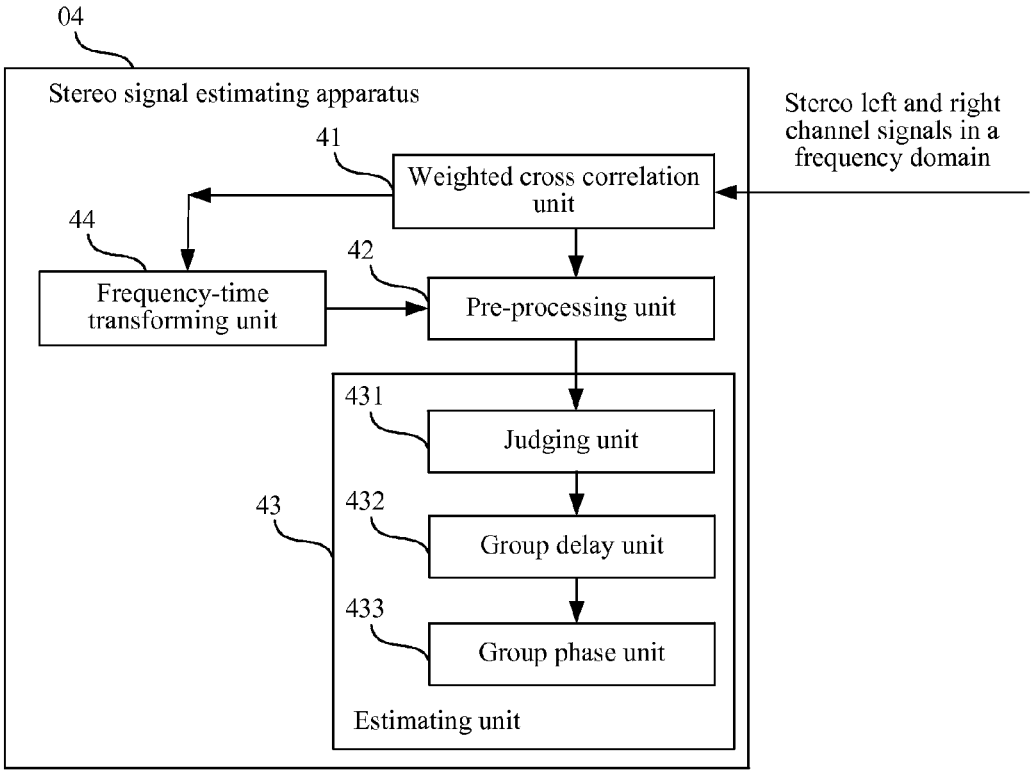
FIG. 8 is a schematic diagram of another embodiment of a stereo signal estimating apparatus.

The estimating unit 43 estimates the group delay and the group phase between the stereo left and right channel signals according to output of the pre-processing unit 42 or output of the frequency-time transforming unit 44. As shown in FIG. 8, the estimating unit 43 further includes: a judging unit 431, configured to receive the cross correlation function time frequency signal output by the re-processing unit 42 or the frequency-time transforming unit 44, and judge a relationship between the index corresponding to the value of the maximum amplitude in the time domain signal cross correlation function and a symmetric interval related to the transform length N, and a judgment result is sent to a group delay unit 432, so as to activate the group delay unit 432 to estimate the group delay between the stereo signal left and right channels.

In one embodiment, if the result of the judging unit 431 is that the index corresponding to the value of maximum amplitude in the time domain signal cross correlation function is smaller than or equal to N/2, the group delay unit 432 estimates that the group delay is equal to the index corresponding to the value of the maximum amplitude in the time domain signal cross correlation function, and if the result of the judging unit 431 is that the index corresponding to the value of the maximum amplitude in the correlation function is greater than N/2, the group delay unit 432 estimates that the group delay is the index minus the transform length N. [0, N/2] and (N/2, N] may be regarded as a first symmetric interval and a second symmetric interval related to the stereo signal time-frequency transform length N.

In another embodiment, a judgment range may be a first symmetric interval and a second symmetric interval of [0, m] and (N−m, N], where m is smaller than N/2. The index corresponding to the value of the maximum amplitude in the time domain signal cross correlation function is compared with related information about m, if the index corresponding to the value of the maximum amplitude in the time domain signal cross correlation function is in the interval [0, m] the group delay is equal to the index corresponding to the value of the maximum amplitude in the time domain signal cross correlation function, and if the index corresponding to the value of the maximum amplitude in the time domain signal cross correlation function is in the interval (N−m, N], the group delay is the index minus the transform length N.

However, in a practical application, the judgment may be made on a critical value of the index corresponding to the value of the maximum amplitude in the time domain signal cross correlation function, and an index corresponding to a value slightly smaller than that of the maximum amplitude may be appropriately selected as a judgment condition without affecting a subjective effect or according to limitation of needs, for example, an index corresponding to a value of the second greatest amplitude or an index corresponding to a value with a difference from that of the maximum amplitude in a fixed or preset range are applicable, including one form below or any transformation of the form:

$$d_g = \begin{cases} \operatorname{argmax}|C_{ravg}(n)| & \operatorname{argmax}|C_{ravg}(n)| \leq N/2 \\ \operatorname{argmax}|C_{ravg}(n)| - N & \operatorname{argmax}|C_{ravg}(n)| > N/2, \end{cases}$$

where arg max $|C_{ravg}(n)|$ denotes an index corresponding to a value of a maximum amplitude in $C_{ravg}(n)$.

A group phase unit 433 receives the result of the group delay unit 432, makes determination according to the phase angle corresponding to the time domain signal cross correlation function of the estimated group delay, when the group delay $d_g$ is greater than or equal to zero, estimates and obtains the group phase by determining a phase angle which corresponds to a cross correlation value corresponding to $d_g$; and when $d_g$ is less than zero, the group delay is a phase angle which corresponds to a cross correlation value corresponding to a $d_g$+N index, which can be specifically embodied in one form below or any transformation of the form:

$$\theta_g = \begin{cases} \angle C_{ravg}(d_g) & d_g \geq 0 \\ \angle C_{ravg}(d_g + N) & d_g < 0, \end{cases}$$

where $\angle C_{ravg}(d_g)$ denotes a phase angle of a time domain signal cross correlation function value $C_{ravg}(d_g)$, and $\angle C_{ravg}(d_g+N)$ is a phase angle of a time domain signal cross correlation function value $C_{ravg}(d_g+N)$.

Figure 9:
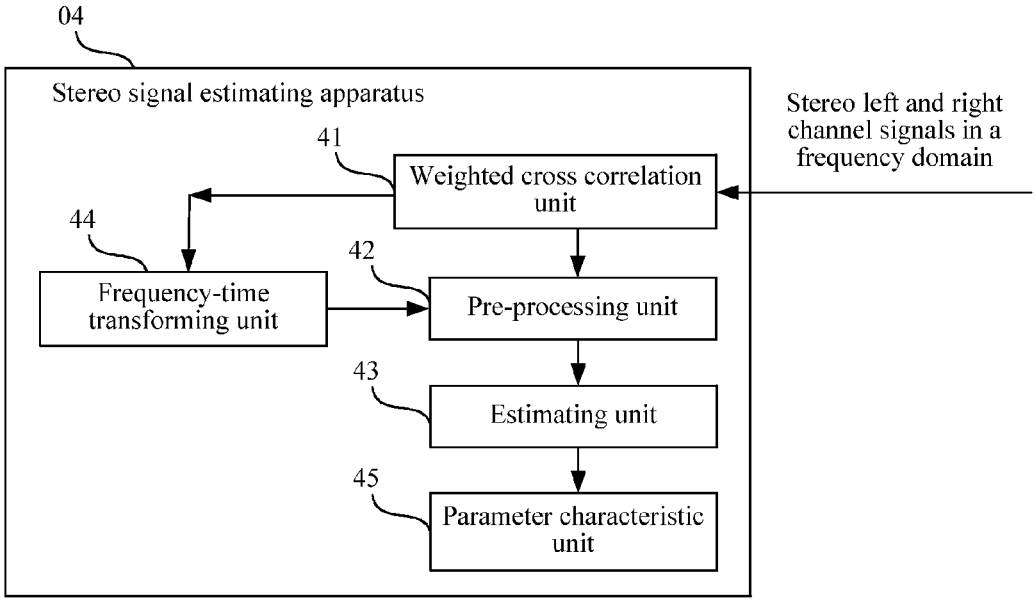
FIG. 9 is a schematic diagram of another embodiment of a stereo signal estimating apparatus.

In another embodiment, the stereo signal estimating apparatus 04 further includes a parameter characteristic unit 45. Referring to FIG. 9, the parameter characteristic unit estimates and obtains a stereo parameter IPD according to information about the group phase and the group delay.

With introduction of this embodiment of the present invention, the group delay and the group phase are estimated and applied to the stereo coding, so that more accurate sound field information can be obtained at a low bit rate by using a global orientation information estimating method, a sound field effect is enhanced, and coding efficiency is improved greatly.

Figure 10:
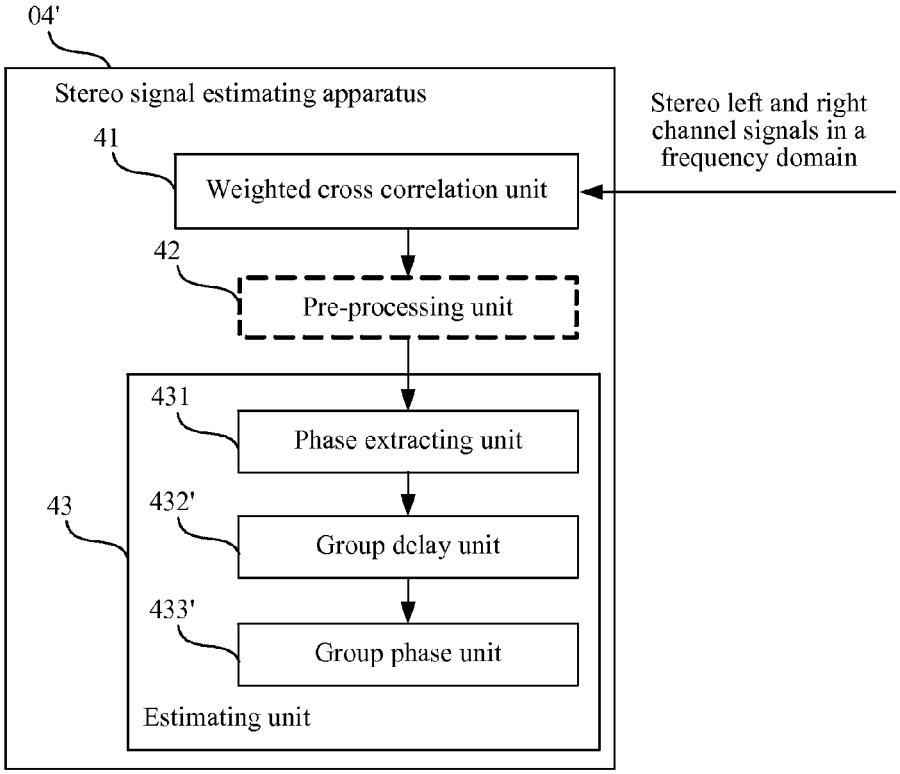
FIG. 10 is a schematic diagram of another embodiment of a stereo signal estimating apparatus.

FIG. 10 is a schematic diagram of a sixth embodiment of a stereo signal estimating apparatus 04'. Unlike the fifth embodiment, according to this embodiment, a weighted cross correlation function of the stereo left and right channel frequency domain signals, which is determined by a weighted cross correlation unit, is transmitted to a pre-processing unit 42 or an estimating unit 43, the estimating unit 43 extracts a phase of the cross correlation function, determines a group delay according to a ratio of a product of a phase difference and transform length to frequency information, and obtains information about a group phase according to a difference between a phase of a current frequency point of the cross correlation function and a product of a frequency point index and a phase difference mean.

The estimating unit 43 estimates the group delay and the group phase between the stereo left and right channel signals according to output of the pre-processing unit 42 or output of a weighted cross correlation unit 41. The estimating unit 43 further includes: a phase extracting unit 430, configured to extract a phase $\hat{\Phi}(k)=\angle C_r(k)$ of the cross correlation function or the processed cross correlation function, where function $\angle C_r(k)$ is used to extract a phase angle of a complex number $C_r(k)$; a group delay unit 432', configured to obtain a phase difference mean $\alpha_1$ in a frequency of a low band; and a group phase unit 433', configured to determine the group delay according to the ratio of the product of a phase difference and transform length to frequency information. Similarly, the information about the group phase can be specifically obtained according to the difference between a phase of a current frequency point of the cross correlation function and a product of a frequency point index and the phase difference mean in the following manner:

$$\alpha_1 = E\{\hat{\Phi}(k+1) - \hat{\Phi}(k)\} \quad k < \text{Max}$$

$$d_g = -\frac{a_1 N}{2 * \pi * Fs}$$

$$\theta_g = E\{\hat{\Phi}(k) - a_1 * k\} \quad k < \text{Max}$$

where $E\{\hat{\Phi}(k+1)-\hat{\Phi}(k)\}$ denotes the phase difference mean, Fs denotes a frequency adopted, and Max denotes a cut-off upper limit for calculating the group delay and the group phase, so as to prevent phase rotation.

In the stereo coding device according to this embodiment of the present invention, the group delay and the group phase which are between stereo left and right channels and can embody signal global orientation information are estimated by using the left and right channel signals in the frequency domain, so that orientation information about sound field is efficiently enhanced, and stereo signal spatial characteristic parameters and the estimation of the group delay and the group phase are combined and applied to stereo coding with a low demand of a bit rate, so that space information and the global orientation information are combined efficiently, more accurate sound field information is obtained, a sound field effect is enhanced, and coding efficiency is improved greatly.

Figure 11:
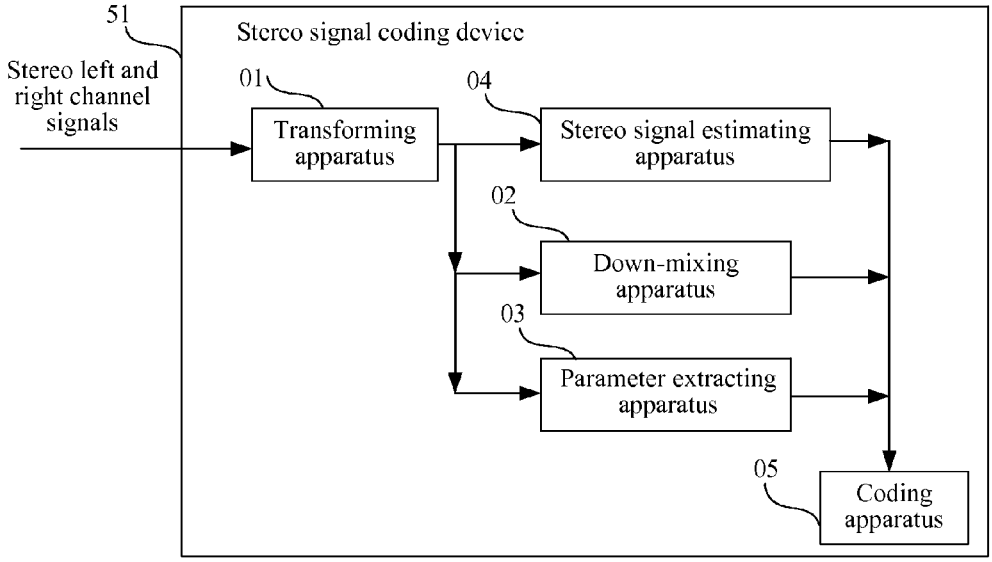
FIG. 11 is a schematic diagram of an embodiment of a stereo signal coding device.

FIG. 11 is a schematic diagram of a seventh embodiment of a stereo signal coding device 51. The device includes a transforming apparatus 01 that is configured to transform a stereo left channel signal and a stereo right channel signal in a time domain to a frequency domain to form a left channel signal and a right channel signal in the frequency domain. A down-mixing apparatus 02 is configured to down-mix the left channel signal and the right channel signal in the frequency domain to generate a monophonic down-mix signal. A parameter extracting apparatus 03 is configured to extract spatial parameters of the left channel signal and the right channel signal in the frequency domain. A stereo signal estimating apparatus 04 is configured to estimate a group delay and a group phase between stereo left and right channels by using the left channel signal and the right channel signal in the frequency domain. A coding apparatus 05 is configured to perform quantization coding on the group delay, the group phase, the spatial parameters and the monophonic down-mix signal.

The stereo signal estimating apparatus 04 is applicable to the fourth, fifth and sixth embodiments described above. The stereo signal estimating apparatus 04 receives the left channel signal and the right channel signal in the frequency domain which are obtained through the transforming apparatus 01, estimates and obtains the group delay and the group phase between the stereo left and right channels according to the left and right channel signals in the frequency domain by using any of the implementation manners according to the embodiments above, and transmits the obtained group delay and group phase to the coding apparatus 05.

Similarly, the coding apparatus 05 further receives the spatial parameters of the left channel signal and the right channel signal in the frequency domain which are extracted by the parameter extracting apparatus 03, the coding apparatus 05 performs quantization coding on received information to form side information, and the coding apparatus 05 quantizes bits obtained after quantization coding is performed on the down-mix signal. The coding apparatus 05 may be an integral part, configured to receive different pieces of information for quantization coding, or may be divided into a plurality of coding devices to process the different pieces of information received, for example, a first coding apparatus 501 is connected to the down-mixing apparatus 02 and is configured to perform quantization coding on down-mix information, a second coding apparatus 502 is connected to the parameter extracting apparatus and is configured to perform quantization coding on the spatial parameters, and a third coding apparatus 503 is connected to the stereo signal estimating apparatus and configured to perform quantization coding on the group delay and the group phase.

In another embodiment, if the stereo signal estimating apparatus 04 includes a parameter characteristic unit 45, the coding apparatus may also include a fourth coding apparatus configured to perform quantization coding on an IPD. When the IPD is quantized, the group delay (Group Delay) and the group phase (Group Phase) are used to estimate $\overline{IPD(k)}$, differential processing is performed on the $\overline{IPD(k)}$ and original IPD(k), and differential IPD is quantization coded, which can be denoted as follows:

$$\overline{IPD(k)} = \frac{-2\pi d_g * k}{N} + \theta_g,\ 1 \le k \le N/2 - 1$$

$IPD_{diff}(k)=IPD(k)-\overline{IPD(k)}$, $IPD_{diff}(k)$ is quantized to obtain quantized bits. In another embodiment, the IPD may be directly quantized, a bit stream is slightly higher, and quantization is more precise.

The stereo coding device 51, according to different needs, may be a stereo coder or another device for coding a stereo multi-channel signal.

Figure 12:
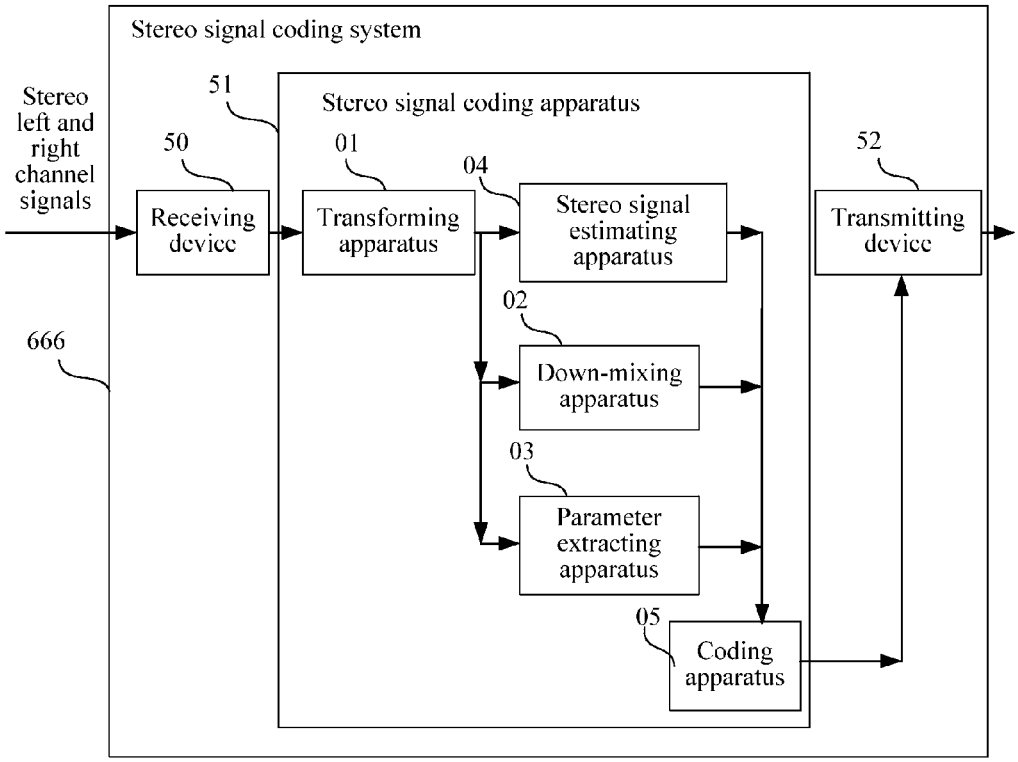
FIG. 12 is a schematic diagram of an embodiment of a stereo signal coding system.

FIG. 12 is a schematic diagram of an eighth embodiment of a stereo signal coding system 666. The system, on the basis of the stereo signal coding device 51 in the seventh embodiment, further includes a receiving device 50 that is configured to receive a stereo input signal for the stereo signal coding device 51; and a transmitting device 52, configured to transmit a result of the stereo signal coding device 51. In a general case, the transmitting device 52 sends the result of the stereo signal coding device to a decoding end for decoding.

Persons of ordinary skill in the art may understand that, all or part of processes in the method according to the foregoing embodiments may be implemented by a program instructing relevant hardware such as a processor. The program may be stored in a computer-readable storage medium. When the program is executed, the processes of the foregoing method embodiments may be included. The storage medium may be a magnetic disk, a compact disk, a read-only memory (ROM), a random access memory (RAM), and so on.

Finally, it should be noted that the foregoing embodiments are merely for describing the technical solutions according to the embodiments of the present invention, but not intended to limit the present invention. although the present invention has been described in detail with reference to the exemplary embodiments, persons of ordinary skill in the art should understand that, modifications or equivalent replacements can still be made to the technical solutions described in the embodiments of the present invention, as long as such modifications or equivalent replacements do not make technical solutions after modification depart from the spirit and scope of the present invention. Persons of ordinary skill in the art may understand that, in a case without any collision, the embodiments or features of different embodiments may be combined with each other to form a new embodiment.

What is claimed is:

1. A stereo coding method, comprising:

transforming a stereo left channel signal and a stereo right channel signal in a time domain to form a left channel signal and a right channel signal in a frequency domain;

down-mixing the left channel signal and the right channel signal in the frequency domain to generate a monophonic down-mix signal;

transmitting bits obtained after quantization coding is performed on the down-mix signal;

extracting spatial parameters of the left channel signal and the right channel signal in the frequency domain;

estimating a group delay and a group phase between stereo left and right channels by using the left channel signal and the right channel signal in the frequency domain; and performing quantization coding on the group delay, the group phase and the spatial parameters.

2. The method according to claim 1, wherein before estimating the group delay and the group phase, the method further comprises determining a cross correlation function between stereo left and right channel signals in the frequency domain, wherein the cross correlation function comprises weighting of a conjugate product of the left channel signal and the right channel signal in the frequency domain.

3. The method according to claim 2, wherein the cross correlation function Cr(k) is:

$$C_r(k) = \begin{cases} X_1(k)X_2^*(k)/|X_1(k)||X_2(k)| & k = 0 \\ 2 * X_1(k)X_2^*(k)/|X_1(k)||X_2(k)| & 1 \le k \le N/2 - 1 \\ X_1(k)X_2^*(k)/|X_1(k)||X_2(k)| & k = N/2 \\ 0 & k > N/2, \end{cases}$$

or $$C_r(k) = \begin{cases} X_1(k)X_2^*(k) \Big/ \sqrt{X_1(k)^2 + X_2(k)^2} & k = 0 \\ 2 * X_1(k)X_2^*(k) \Big/ \sqrt{X_1(k)^2 + X_2(k)^2} & 1 \le k \le N/2 - 1 \\ X_1(k)X_2^*(k) \Big/ \sqrt{X_1(k)^2 + X_2(k)^2} & k = N/2 \\ 0 & k > N/2; \end{cases}$$

wherein N denotes stereo signal time-frequency transform length, k denotes a frequency-point index value, and $|X_1(k)|$ and $|X_2(k)|$ denote amplitudes corresponding to $X_1(k)$ and $X_2(k)$, respectively.

4. The method according to claim 3, wherein the method further comprises:

performing inverse time-frequency transform on the cross correlation function to obtain a cross correlation function time domain signal, or performing inverse time-frequency transform on the cross correlation function to obtain a cross correlation function time domain signal, and pre-processing the cross correlation function time domain signal.

5. The method according to claim 4, wherein estimating the group delay and the group phase comprises:

estimating the group delay according to the cross correlation function time domain signal or based on an index corresponding to a value of a maximum amplitude in the processed cross correlation function time domain signal;

obtaining a phase angle that corresponds to a cross correlation function corresponding to the group delay; and estimating the group phase according to the phase angle.

6. The method according to claim 3, wherein estimating the group delay and the group phase comprises:

extracting a phase of the cross correlation function;

determining the group delay according to a ratio of a product of a phase difference mean and a transform length to frequency information; and obtaining information about the group phase according to a difference between a phase of a current frequency point of the cross correlation function and a product of an index of the current frequency point and the phase difference mean.

7. The method according to claim 5, wherein the method further comprises:

estimating and obtaining stereo sub-band information according to the group delay and the group phase; and performing quantization coding on the sub-band information, wherein the sub-band information comprises an interchannel phase difference parameter between the left and right channels, a cross correlation parameter, and/or an overall phase difference parameter of the left channel and the down-mix signal.

8. A stereo signal coding device, comprising:

a transforming apparatus, configured to transform a stereo left channel signal and a stereo right channel signal in a time domain to form a left channel signal and a right channel signal in a frequency domain;

a down-mixing apparatus, configured to down-mix the left channel signal and the right channel signal in the frequency domain to generate a monophonic down-mix signal;

a parameter extracting apparatus, configured to extract spatial parameters of the left channel signal and the right channel signal in the frequency domain;

a stereo signal estimating apparatus, configured to estimate a group delay and a group phase between stereo left and right channels by using the left channel signal and the right channel signal in the frequency domain; and a coding apparatus, configured to perform quantization coding on the group delay, the group phase, the spatial parameters and the monophonic down-mix signal.

9. The device according to claim 8, wherein the stereo signal estimating apparatus, before estimating the group delay and the group phase is further configured to determine a cross correlation function between the stereo left and right channel signals in the frequency domain, wherein the cross correlation function comprises weighting of a conjugate product of the left channel signal and the right channel signal in the frequency domain.

10. The device according to claim 9, wherein the weighted cross correlation function is denoted as:

$$C_r(k) = \begin{cases} X_1(k)X_2^*(k)/|X_1(k)||X_2(k)| & k = 0 \\ 2 * X_1(k)X_2^*(k)/|X_1(k)||X_2(k)| & 1 \le k \le N/2 - 1 \\ X_1(k)X_2^*(k)/|X_1(k)||X_2(k)| & k = N/2 \\ 0 & k > N/2, \end{cases}$$

-continued or $$C_r(k) = \begin{cases} X_1(k)X_2^*(k) \Big/ \sqrt{X_1(k)^2 + X_2(k)^2} & k = 0 \\ 2 * X_1(k)X_2^*(k) \Big/ \sqrt{X_1(k)^2 + X_2(k)^2} & 1 \le k \le N/2 - 1 \\ X_1(k)X_2^*(k) \Big/ \sqrt{X_1(k)^2 + X_2(k)^2} & k = N/2 \\ 0 & k > N/2 \end{cases}$$

wherein N denotes stereo signal time-frequency transform length, k denotes a frequency-point index value, and $|X_1(k)|$ and $|X_2(k)|$ denote amplitudes corresponding to $X_1(k)$ and $X_2(k)$, respectively.

11. The device according to claim 10, wherein the stereo signal estimating apparatus comprises a frequency-time transforming unit, configured to perform inverse time-frequency transform on the cross correlation function to obtain a cross correlation function time domain signal, or configured to perform inverse time-frequency transform on the cross correlation function to obtain a cross correlation function time domain signal, and pre-process the cross correlation function time domain signal.

12. The device according to claim 11, wherein the stereo signal estimating apparatus further comprises an estimating unit, configured to estimate and obtain the group delay according to the cross correlation function time domain signal or based on an index corresponding to a value of a maximum amplitude in the processed cross correlation function time domain signal, obtain a phase angle which corresponds to a cross correlation function corresponding to the group delay, and estimate and obtain the group phase according to the phase angle.

13. The device according to claim 10, wherein the stereo signal estimating apparatus comprises an estimating unit, configured to extract a phase of the cross correlation function, and determine the group delay according to a ratio of a product of a phase difference mean and transform length to frequency information; and obtain information about the group phase according to a difference between a phase of a current frequency point of the cross correlation function and a product of an index of the current frequency point and the phase difference mean.

* * * * *